US012195884B2

(12) United States Patent
Goenka et al.

(10) Patent No.: US 12,195,884 B2
(45) Date of Patent: Jan. 14, 2025

(54) BI-COMPONENT CONTINUOUS FILAMENTS AND ARTICLES MADE THEREFROM

(71) Applicant: WELSPUN FLOORING LIMITED, Mumbai (IN)

(72) Inventors: Dipali Goenka, Mumbai (IN); Utpal Haldar, Mumbai (IN)

(73) Assignee: Welspun Flooring Limited, Mumbai (IN)

( * ) Notice: Subject to any disclaimer, the term of this patent is extended or adjusted under 35 U.S.C. 154(b) by 528 days.

(21) Appl. No.: 16/936,520

(22) Filed: Jul. 23, 2020

(65) Prior Publication Data

US 2021/0010166 A1 Jan. 14, 2021

Related U.S. Application Data

(63) Continuation-in-part of application No. 15/663,887, filed on Jul. 31, 2017, now Pat. No. 10,760,186.

(30) Foreign Application Priority Data

Mar. 29, 2017 (IN) ..... 201721011143

(51) Int. Cl.
*D01F 8/14* (2006.01)
*D01F 8/06* (2006.01)
*D01F 8/12* (2006.01)

(52) U.S. Cl.
CPC ..... *D01F 8/14* (2013.01); *D01F 8/06* (2013.01); *D01F 8/12* (2013.01)

(58) Field of Classification Search
CPC ..... D01F 1/04; D01F 11/04; D01F 8/04
(Continued)

(56) References Cited

U.S. PATENT DOCUMENTS 3,700,544 A 10/1972 Matsui
3,803,453 A 4/1974 Hull
(Continued)

FOREIGN PATENT DOCUMENTS

| | | |
|---|---|---|
| CA | 2208494 | 4/1998 |
| CN | 102131968 | 7/2011 |
| WO | WO 9806562 | 2/1998 |

OTHER PUBLICATIONS

Radicigroup, "Polyester and Polyamide Biocomponent Yarn," Jul. 2012, Eng/Radyarn BiCo (2 pages).
(Continued)

*Primary Examiner* — Lynda Salvatore
(74) *Attorney, Agent, or Firm* — Finnegan, Henderson, Farabow, Garrett & Dunner, LLP

(57) ABSTRACT

The present disclosure generally relates to bi-component continuous filaments and articles made therefrom. In one embodiment, a bi-component continuous filament is disclosed, comprising a first polymer component forming a sheath; a second polymer component comprising a core that is surrounded by the sheath; and a binding agent adhering the first polymer component to the second polymer component along a length of the filament; wherein an elongation of the bi-component continuous filament is between 33.6±5.0–60.4±5.0 percent; and wherein a tenacity of the bi-component continuous filament is between 1.9±0.2–3.9±0.2 grams per denier (GPD). In some embodiments, the first polymer component comprises a polyamide, polyester, or polyolefin material, preferably a cationic polyamide or a cationic polyester, the second polymer component comprises polyethylene terephthalate (PET), and the binding agent comprises a polyolefin modified by maleic anhydride.

34 Claims, 5 Drawing Sheets

(58) Field of Classification Search
USPC ..... 428/373, 372
See application file for complete search history.

(56) References Cited

U.S. PATENT DOCUMENTS 3,992,499 A 11/1976 Lee
4,019,311 A 4/1977 Schippers
4,075,378 A 2/1978 Anton et al.
4,439,487 A 3/1984 Jennings
4,987,030 A 1/1991 Saito et al.
5,213,892 A 5/1993 Bruckner
5,372,885 A * 12/1994 Tabor ..... D01F 8/14 428/374
5,445,884 A 8/1995 Hoyt et al.
5,464,676 A 11/1995 Hoyt et al.
5,885,705 A 3/1999 Kent et al.
5,888,651 A 3/1999 Hoyt et al.
5,948,529 A * 9/1999 Hastie ..... D01F 8/06 428/373
5,958,548 A * 9/1999 Negola ..... D06N 7/0065 428/95
6,004,674 A 12/1999 Kent et al.
6,039,903 A 3/2000 Kent et al.
6,531,218 B2 3/2003 Hoyt et al.
6,881,468 B2 4/2005 Hoyt et al.
9,163,356 B2 10/2015 Kulk et al.
2008/0160278 A1 7/2008 Cheng et al.
2012/0244310 A1 9/2012 Visscher
2015/0240389 A1 * 8/2015 Chen ..... D01F 8/14 428/373

OTHER PUBLICATIONS

Standard Test Method for Crimp and Shrinkage Properties for Textured Yarns Using a Dynamic Textured Yarn Tester, Designation: D6774-02 (Reapproved 2010), ASTM International, pp. 1-6.
Standard Test Method for Tensile Properties of Yarns by the Single-Strand Method, Designation: D2256/D2256M-10 (Reapproved 2015), ASTM International, pp. 1-13.
Standard Test Method for Shrinkage of Yarns, Designation: D2259-02 (Reapproved 2016), ASTM International, pp. 1-6.

* cited by examiner

BI-COMPONENT CONTINUOUS FILAMENTS AND ARTICLES MADE THEREFROM

PRIORITY CLAIM

This application is a continuation-in-part application of U.S. patent application Ser. No. 15/663,887, titled "MANUFACTURE OF BI-COMPONENT CONTINUOUS FILAMENTS AND ARTICLES MADE THEREFROM," filed on Jul. 31, 2017, which in turn claims the benefit of Indian provisional application no. 201721011143, filed on Mar. 29, 2017. The entire contents of the aforementioned applications are incorporated herein by reference.

TECHNICAL FIELD

The present disclosure generally relates to bi-component continuous filaments and articles made therefrom, including yarns and fabrics, and end-use applications thereof, preferably including floor coverings such as mats, rugs, tiles, and carpets.

BACKGROUND

Continuous filaments are well known in the textile industry. A continuous filament generally comprises a polymer material that is extruded as a long fiber. Such fibers can be twisted together and heat set to form strands of yarn. The yarn can be texturized for increased bulkiness and better wear resistance. Often continuous filament yarns are used in carpets as an alternative to yarn comprised of staple fibers. Indeed, the use of bulked continuous filaments in carpets, sometimes referenced as "BCF fibers," and other advances in technology have resulted in the ability to create filament looks that were impractical in the past and have made filament production faster and more economical than before. Styles previously made using only spun yarn can now be made using BCF fibers.

Various types of continuous filaments have been developed over the years and have been employed for a variety of uses based on the polymers used. Early examples can be found in U.S. Pat. Nos. 4,075,378 and 4,439,487, each of which has been assigned to E. I. du Pont de Nemours and Company. A bi-component continuous filament is a continuous filament made by extruding two different components that together form the long fiber; the two components generally comprise two different polymer materials that are extruded together. Some existing bi-component continuous filaments have been designed by employing a sheath-core arrangement, in which a lower melting temperature polymer is used to form a sheath component and a higher melting temperature polymer is used to form a core component of the bi-component continuous filament. Such bi-component continuous filaments have been used in nonwoven webs to thermally bond the webs together.

Some existing yarns made from bi-component continuous filaments consist of a raw white (i.e., color-free) polymer component that has a fine count in texturized polyester pre-oriented yarn (sometimes referred to as partially oriented yarn), which is typically made by spinning polyester chips of polyethylene terephthalate (PET). Polymer components of bi-component continuous filaments also can be dyed at some point after the bi-component continuous filament has been spun.

Unfortunately, many articles made from bi-component continuous filaments and yarns thereof undergo delamination over time. Delamination is a form of degradation in which the polymer components begin to separate from one another. This especially likely to occur when high levels of wear and tear are involved, affecting the integrity and long-term durability of such articles.

It is believed that there is a need for improvements in the field of making bi-component continuous filaments and the articles made therefrom. There is a need to increase the durability, resilience and/or color-fastness of bi-component continuous filaments and articles made therefrom for use across a wide range of applications including textile products, and particularly, floor coverings. These, and other needs, are believed to be addressed by one or more preferred embodiments of the present disclosure.

SUMMARY

Embodiments of the present disclosure includes many aspects and features. While many of these aspects and features relate to the context of floor coverings, the embodiments are not limited to use in floor coverings. Instead, as will become apparent from the following summaries and detailed descriptions of aspects, features, and embodiments, it should be understood that the disclosed embodiments could be used in a variety of applications in the textile industry and other industries.

In one embodiment, a bi-component continuous filament is disclosed, comprising: a first polymer component forming a sheath; a second polymer component comprising a core that is surrounded by the sheath; and a binding agent adhering the first polymer component to the second polymer component along a length of the filament; wherein an elongation of the bi-component continuous filament is between 33.6±5.0–60.4±5.0 percent; and wherein a tenacity of the bi-component continuous filament is between 1.9±0.2–3.9±0.2 grams per denier (GPD).

In one aspect, the first polymer component comprises a polyamide, polyester, or polyolefin material.

In another aspect, the first polymer component comprises a cationic polyamide or a cationic polyester.

In another aspect, at least one of the first and second polymer components comprises polyamide, and wherein the polyamide comprises nylon 6; nylon 6,6; nylon 7; nylon 6,10; nylon 6,12; nylon 12; nylon 46; or nylon 1212.

In another aspect, at least one of the first and second polymer components comprises polyester, and wherein the polyester comprises polyethylene terephthalate (PET), polybutylene terephthalate (PBT), or polytrimethylene terephthalate (PTT).

In another aspect, the polymer of the first polymer component is different than the polymer of the second polymer component.

In another aspect, the binding agent comprises a polyolefin.

In another aspect, the binding agent comprises a polyolefin modified by an acid anhydride.

In another aspect, the acid anhydride comprises polyethylene (PE), ethylene-vinyl acetate (EVA), or polypropylene (PP).

In another aspect, the acid anhydride comprises maleic anhydride.

In another aspect, the second polymer component comprises a polyamide, polyester, or polyolefin material.

In another aspect, the second polymer component comprises a cationic polyamide or a cationic polyester.

In another aspect, the bi-component continuous filament is comprised in a yarn and heat set to form a yarn with an oval cross-section.

In another aspect, at least one of the first polymer and second polymer are solution dyed with a pigment and/or solvent.

In another aspect, the bi-component continuous filament is solution dyed with a pigment.

In another aspect, the bi-component continuous filament is solution dyed with a pigment and a solvent.

In another aspect, the bi-component continuous filament is hank dyed.

In another aspect, the bi-component continuous filament is a cross-sectional shape which is circular, elliptical, tri-lobal, polygonal (e.g., triangular, square, pentagonal, etc.), or star-shaped.

In another aspect, the core is generally arranged concentrically or eccentrically relative to the sheath.

In another aspect, the bi-component continuous filament has a square cross-section.

In another aspect, a functional additive is included in at least one of the first polymer component or the second polymer component, to increase the bi-component continuous filament's fire retardancy, fire resistance, antimicrobial, antibacterial, antifungal, and/or anti-staining properties.

In another aspect, the bi-component continuous filament exhibits a denier per filament (DPF) ratio measuring from approximately 2 DFP to approximately 50 DPF.

In another aspect, the bi-component continuous filament exhibits a denier per filament (DPF) ratio measuring from approximately 15 DPF to approximately 35 DPF.

In another aspect, the bi-component continuous filament is comprised in a yarn measuring from approximately 500 to 3500 denier.

In another aspect, the bi-component continuous filament is comprised in a yarn measuring from approximately 1000 to 2000 denier.

In another aspect, either or both polymer components can be formed to have any of a variety of cross-sectional shapes, including (but not limited to): circular, elliptical, tri-lobal, polygons with any number of sides (e.g., triangular, square, pentagonal, etc.), star, and the like. These cross-sectional shapes may be achieved by modifying the spinneret design. The resulting bi-component fiber may have a generally uniform cross-sectional shape along the length.

In another aspect, the polymer components may comprise many types of commercially available polymers. Polyamide, polyester, or polyolefin may be used to form the core and/or sheath of the bi-component continuous filament. The polymers selected may be modified to be cationic (e.g., cationic polyamide or cationic polyester). The polymer materials may be recycled or virgin materials. The polymer material that comprises the core may be the same or different from the polymer material that comprises the sheath. The core may be arranged concentrically or eccentrically relative to the sheath. The bi-component continuous filament may comprise a large range of filament sizes and be implemented into a large range of yarn sizes. The bi-component continuous filaments may be treated to reduce luster.

In another aspect, the binding agent comprises a polyolefin. In some applications, the polyolefin used may be modified by an acid anhydride. The polyolefin may further comprise polyethylene (PE), ethylene-vinyl acetate (EVA), and/or polypropylene (PP). The acid anhydride may further comprise maleic anhydride.

In another aspect, functional additives may be added to the first and/or second polymer component to achieve desirable properties, including (but not limited to): fire retardancy, fire resistance, antimicrobial, antibacterial, antifungal, and anti-staining properties.

In another aspect, the bi-component continuous filament may be undyed/uncolored (i.e. raw white), solution dyed, or hank dyed. When solution dyeing, a pigment may be used alone or with a solvent. The pigments used may be in an organic or inorganic form.

In another aspect, a method of making a bi-component continuous filament comprises the steps of: providing in a first mixer a first polymer comprising a polyamide, a polyolefin, or a polyester; providing in a second mixer both a binding agent comprising a polyolefin modified by an acid anhydride, and a second polymer comprising a polyamide, a polyolefin, or a polyester; heating the first polymer to form a first polymer melt; heating the second polymer to form a second polymer melt; extruding using a spinneret, from the first mixture, a first polymer component in the form of a sheath, and from the second mixture, a second polymer component in the form of a core that is surrounded by the sheath, wherein a bi-component continuous filament is obtained, and wherein the binding agent adheres the first polymer component to the second polymer component along a length of the bi-component continuous filament such that the bi-component continuous filament has a generally uniform cross-sectional shape along the length; and heat setting the bi-component continuous filament comprising dry heat setting, steam heat setting, or both.

In another aspect, a method of making an article from bi-component continuous filaments comprises the steps of: providing in a first mixer a first polymer comprising a polyamide, a polyolefin, or a polyester; providing in a second mixer both a binding agent comprising a polyolefin modified by an acid anhydride, and a second polymer comprising a polyamide, a polyolefin, or a polyester; heating the first polymer to form a first polymer melt; heating the second polymer to form a second polymer melt; solution dyeing the first polymer melt by adding a first pigment and mixing the first polymer melt and the first pigment to form a first mixture and/or solution dyeing the second polymer melt by adding a second pigment and mixing the second polymer melt and the second pigment to form a second mixture; extruding using a spinneret, from the first mixture, a first polymer component in the form of a sheath, and from the second mixture, a second polymer component in the form of a core that is surrounded by the sheath, whereby bi-component continuous filaments are obtained, and wherein the binding agent adheres the first polymer component to the second polymer component along a length of each bi-component continuous filament such that each bi-component continuous filament has a generally uniform cross-sectional shape along its length; twisting the bi-component continuous filaments; texturizing the bi-component continuous filaments; and heat setting the bi-component continuous filaments comprising dry heat setting, steam heat setting, or both.

In another aspect, an article comprises bi-component continuous filaments of or made according to one or more of the foregoing aspects and features.

In another aspect, bulk continuous filament (BCF) fibers comprise bi-component continuous filaments of or made according to one or more of the foregoing aspects and features.

In another aspect, a hank dyed yarn product comprises the bi-component continuous filament.

In another aspect, a woven textile product comprises bi-component continuous filaments of or made according to one or more of the foregoing aspects and features.

In another aspect, a tufted textile product comprises bi-component continuous filaments of or made according to one or more of the foregoing aspects and features.

In another aspect, a floor covering comprises bi-component continuous filaments of or made according to one or more of the foregoing aspects and features.

In addition to the foregoing aspects, the disclosed embodiments further encompass the various logical combinations and sub-combinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

One or more preferred embodiments now will be described in detail with reference to the accompanying drawings, wherein the same elements are referred to with the same reference numerals.

DETAILED DESCRIPTION

Figure 1:
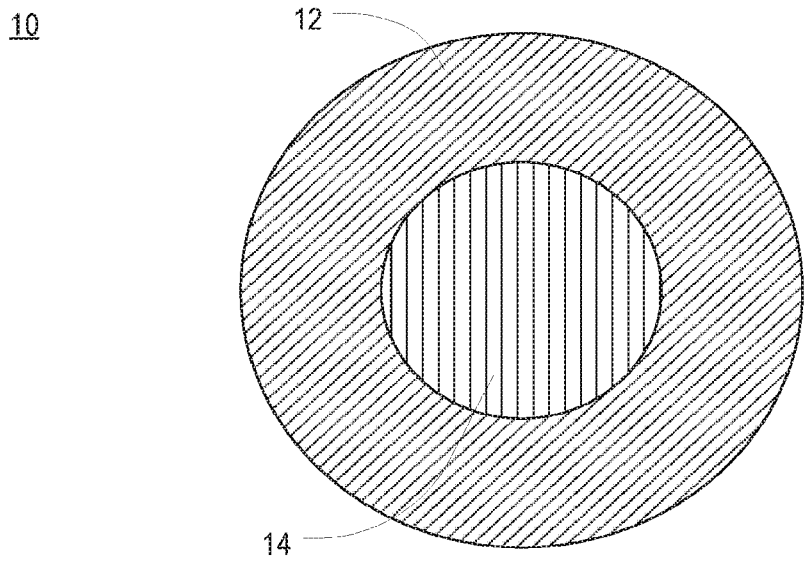
FIG. 1 is a schematic cross-sectional view of an embodiment of a bi-component continuous filament, in accordance with one or more aspects of the present disclosure, depicting the bi-component filament as having a circular cross-sectional shape with the polymer components in a concentrically-arranged sheath-core relationship.

As a preliminary matter, it will readily be understood by one having ordinary skill in the relevant art ("Ordinary Artisan") that the disclosed embodiments have broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure. Furthermore, an embodiment may incorporate only one or a plurality of the aspects disclosed herein; only one or a plurality of the features disclosed herein; or combination thereof. As such, many embodiments are implicitly disclosed herein and fall within the scope of this disclosure.

Accordingly, it is to be understood that this disclosure is illustrative and exemplary, and it is made merely for the purposes of providing a full and enabling disclosure. The detailed disclosure herein of one or more embodiments is not intended, nor is to be construed, to limit the scope of patent protection in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term-differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments are next described. The following description of one or more preferred embodiments is merely exemplary in nature and is in no way intended to limit the invention, its implementations, or uses.

Figure 2:
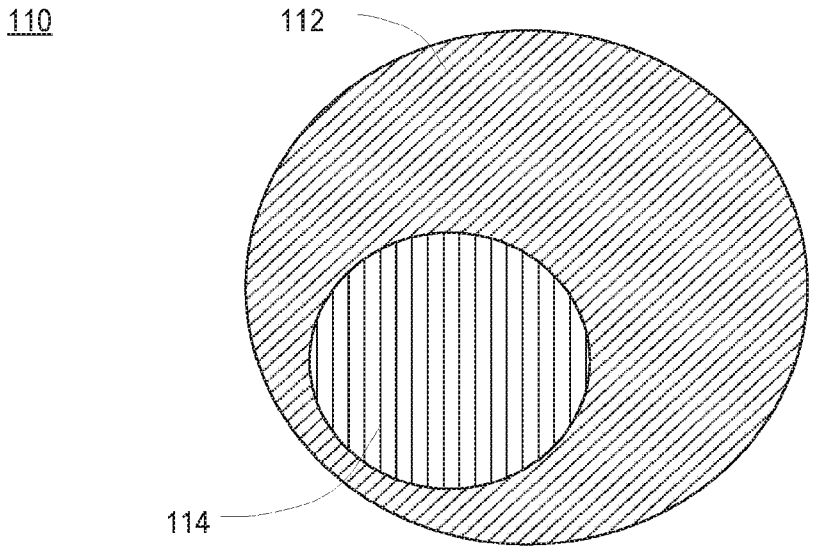
FIG. 2 is a schematic cross-sectional view of an embodiment of a bi-component continuous filament, in accordance with one or more aspects of the present disclosure, depicting the bi-component filament as having a circular cross-sectional shape with the polymer components in an eccentrically-arranged sheath-core relationship.

FIG. 1 is a schematic cross-sectional view of an embodiment of a bi-component continuous filament 10, in accordance with one or more aspects of the present disclosure, depicting the bi-component continuous filament 10 as having a circular cross-sectional shape with the polymer components in a concentrically-arranged sheath-core relationship, and FIG. 2 is a schematic cross-sectional view of an embodiment of a bi-component continuous filament 110, in accordance with one or more aspects of the present disclosure, depicting the bi-component continuous filament 110 as having a circular cross-sectional shape with the polymer components in an eccentrically-arranged sheath-core relationship. In each of FIGS. 1 and 2, a first polymer component 12, 112 entirely surrounds a second polymer component 14, 114 (cross-sectionally) so that the first polymer component 12, 112 forms a sheath around the second polymer component 14, 114, which forms a core. In a preferred embodiment, the first polymer component 12, 112 is different from the second polymer component 14, 114, thereby imparting the bi-component continuous filament 10, 110 with attributes of each filament individually as well as attributes that might arise by the pairing of the selected polymer components.

In FIG. 1, the first and second polymer components 12, 14 are generally concentrically arranged, with the core disposed at a generally central location within the sheath. It should be noted that, though each of the polymer components 12, 14 of the bi-component continuous filament 10 of FIG. 1 is depicted as having a generally circular cross-sectional shape, it is contemplated that either or both polymer components can be formed to have any of a variety of other non-circular cross-sectional shapes, including, but not limited to, elliptical, tri-lobal, polygonal (e.g., triangular, square, pentagonal, etc.), star, and like shapes.

In FIG. 2, the first and second polymer components 112, 114 are eccentrically arranged, with the core disposed at a generally non-central (i.e., off center) location within the sheath. As with FIG. 1, it should be noted that, though each of the polymer components 112, 114 of the bi-component filament 110 of FIG. 2 is depicted as having a generally circular cross-sectional shape, it is contemplated that either or both polymer components can be formed to have any of a variety of other non-circular cross-sectional shapes, including, but not limited to, elliptical shapes, tri-lobal shapes, and the like.

Figure 3:
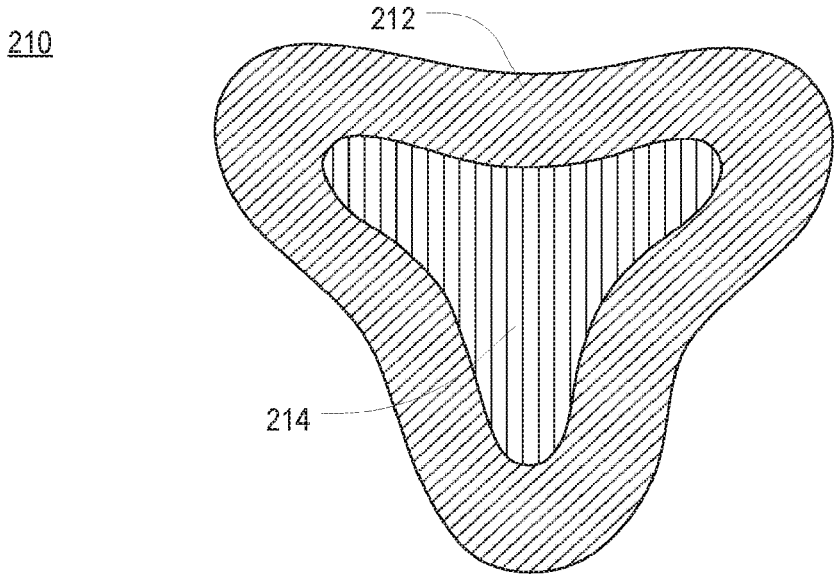
FIGS. 3 and 4 are each schematic cross-sectional views of an embodiment of a bi-component filament, in accordance with one or more aspects of the present disclosure, depicting the bi-component continuous filament as having a tri-lobal cross-sectional shape with the polymer components in a sheath-core relationship.
Figure 4:
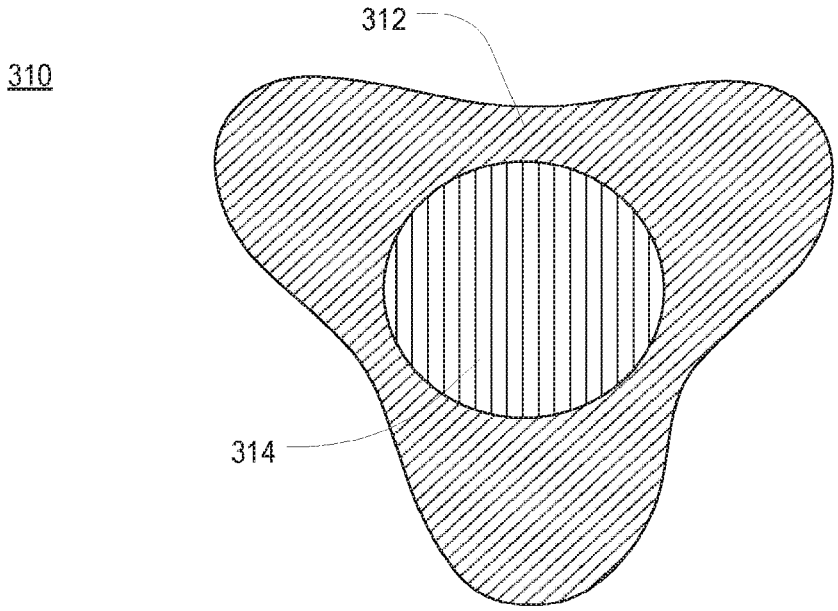

FIGS. 3 and 4 are each schematic cross-sectional views of an embodiment of a bi-component filament 210, 310, in accordance with one or more aspects of the present disclosure, depicting the bi-component continuous filament 210, 310 as having a tri-lobal cross-sectional shape with the polymer components in a sheath-core relationship. In each of FIGS. 3 and 4, a first polymer component 212, 312 entirely surrounds a second polymer component 214, 314 (cross-sectionally) so that the first polymer component 212, 312 forms a sheath around the second polymer component 214, 314, which forms a core. In a preferred embodiment, the first polymer component 212, 312 is different from the second polymer component 214, 314 thereby imparting the bi-component continuous filament 210, 310 with attributes of each filament individually as well as attributes that might arise by the pairing of the selected polymer components.

In FIG. 3, each of the polymer components 212, 214 of the bi-component continuous filament 210 of FIG. 3 is depicted as having a tri-lobal cross-sectional shape. Although the arrangement of the tri-lobal cross-sectional shape of the core relative to the cross-sectional shape of the sheath is shown as being generally symmetric, an asymmetrical arrangement of the core relative to the sheath is likewise contemplated. A tri-lobal cross-sectional shape for each of the first and second polymer component 212, 214 can provide increased surface-to-surface interface between the sheath and the core, thereby enhancing the opportunity for effective adhesion between the polymer components 212, 214.

In at least some embodiments, it may be preferred to use a polymer material in the same polymer family for the core and sheath. (e.g., a core made from recycled polyester and a sheath made from virgin polyester). In embodiments where the core and sheath share similar properties, a binding agent may not be required. In some such embodiments, however, a binding agent may still be desirable. In some embodiments where a binding agent is not used, the surface area of contact between the core and the sheath may be engineered to increase adhesion between the core and sheath. For example, a tri-lobal cross-sectional shape may be used for the core to increase surface area and improve adhesion properties. Any of the other cross-sectional shapes disclosed herein may be used to increase the surface area of contact between the core and the sheath.

In FIG. 4, the first polymer component 312 is depicted as having a tri-lobal cross-sectional shape, and the second polymer component 314 is depicted as having a generally circular shape. As should be clear, it is contemplated that the cross-sectional shape of the sheath and the core of bi-component continuous filaments in accordance with one or more aspects of the present disclosure are not required to embody the same cross-sectional shape. It is contemplated that cross-sectional shapes of the sheath and the core can be selected to provide resulting bi-component filaments with physical attributes that might be well-suited to a particular end-use application.

With regard to each of the bi-component continuous filaments 10, 110, 210, 310 shown and described in connection with each of FIGS. 1-4, a wide variety of different polymers can be selected for implementation as the polymer components. Polymers can be selected to impart the resulting bi-component with desired physical attributes, such as resiliency, durability and/or strength, which may be advantageous for a particular end-use application.

In at least some embodiments, the first polymer component 12, 112, 212, 312, which component is ultimately implemented as the sheath in the resultant bi-component continuous filaments 10, 110, 210, 310, includes a polyamide, a polyolefin, or polyester. Other classes of polymers commonly used in the manufacture of woven textile materials and products are likewise contemplated. A polyamide that can be selected as the first polymer component 12, 112, 212, 312 includes any of a variety of chained polymers having amide linkages, including (but not limited to): nylon 6, nylon 6,6, nylon 7, nylon 6,10, nylon 6,12, nylon 12, nylon 46 or nylon 1212. A polyolefin that can be selected as the first polymer component 12, 112, 212, 312 includes, but is not limited to, polyethylene (PE), ethylene-vinyl acetate (EVA), or polypropylene (PP). A polyester that can be selected as the first polymer component 12, 112, 212, 312 includes, but is not limited to, polyethylene terephthalate (PET), polybutylene terephthalate (PBT), or polytrimethylene terephthalate (PTT). In a preferred embodiment, the first polymer component 12, 112, 212, 312 includes nylon 6. In another preferred embodiment, the first polymer component 12, 112, 212, 312 includes polyethylene terephthalate (PET), polybutylene terephthalate (PBT), or polytrimethylene terephthalate (PTT).

In at least some embodiments, the second polymer component 14, 114, 214, 314, which component is ultimately implemented as the core in the resultant bi-component continuous filaments 10, 110, 210, 310, includes a polyamide, a polyolefin, or a polyester. Other classes of polymers commonly used in the manufacture of woven textile materials and products are likewise contemplated. A polyamide that can be selected as the second polymer component 14, 114, 214, 314 includes any of a variety of chained polymers having amide linkages, but is not limited to, nylon 6, nylon 6,6, nylon 7, nylon 6,10, nylon 6,12, nylon 12, nylon 46 or nylon 1212. A polyolefin that can be selected as the second polymer component 14, 114, 214, 314 includes, but is not limited to, polyethylene (PE), ethylene-vinyl acetate (EVA), or polypropylene (PP). A polyester that can be selected as the second polymer component 14, 114, 214, 314 includes, but is not limited to, polyethylene terephthalate (PET), polybutylene terephthalate (PBT), or polytrimethylene terephthalate (PTT). In a preferred embodiment, the second polymer component 14, 114, 214, 314 includes polypropylene (PP), polyethylene terephthalate (PET), polybutylene terephthalate (PBT), or polytrimethylene terephthalate (PTT).

In at least some embodiments, bi-component continuous filaments 10, 110, 210, 310 include one or more binding agents to facilitate effective adhesion between the first and second polymer components along their respective lengths. It is contemplated that a binding agent can be added to either or both of the first and/or second polymer components when in chip form, prior to heating and extrusion. In a preferred embodiment, the binding agent is mixed with the chip form of the second polymer component 14, 114, 214, 314, which ultimately is used to form the core of the resulting bi-component continuous filaments 10, 110, 210, 310. Once thoroughly mixed, the binding agent is spun (i.e., extruded) with either or both of the and second polymer components so that the first and second polymer components can be bound together in such a way that the resulting bi-component continuous filaments 10, 110, 210, 310 are less likely to undergo delamination (i.e., separation of the first and second polymer components) during preparation and/or use of a textile product utilizing the filament.

It is contemplated that a wide variety of different materials can be used as a binding agent in connection with generation of bi-component continuous filaments 10, 110, 210, 310 in accordance with one or more aspects of the present disclosure. In one contemplated embodiment, the binding agent includes a polyolefin modified by an organic acid anhydride. Polyolefins capable of modification by an organic acid anhydride to function as a binding agent include, but are not limited to, polyethylene (PE), ethylene-vinyl acetate (EVA), and polypropylene (PP). An organic acid anhydride for modifying a polyolefin to function as a binding agent includes, but is not limited to, maleic anhydride.

To illustrate effectiveness of the inclusion of a binding agent in the generation of bi-component filaments in accordance with one or more aspects of the present disclosure, FIGS. 5A-5D are images depicting a plurality of bi-component continuous filaments, arranged in a sheath-core relationship, having parameters similar to that of the bi-component continuous filaments 210 of FIG. 3.

Figure 5A:
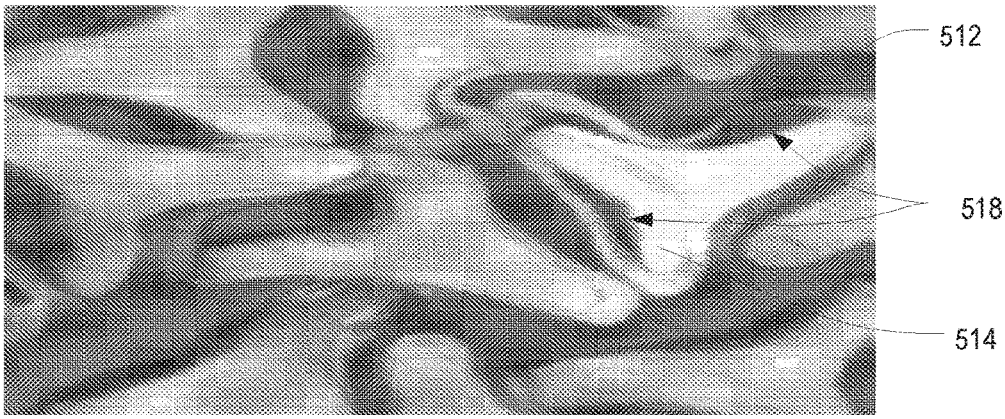
FIGS. 5A-5D are images depicting a plurality of bi-component continuous filament, arranged in a sheath-core relationship, having parameters similar to that of the bi-component continuous filament of FIG. 3.

FIG. 5A depicts a cross-sectional view of bi-component continuous filaments, with a tri-lobal cross-sectional shape, having a sheath formed of a polyamide that includes nylon 6 and a core formed of a polyester that includes polyethylene terephthalate (PET). The bi-component continuous filament depicted in FIG. 5A does not include a binding agent.

Figure 5B:
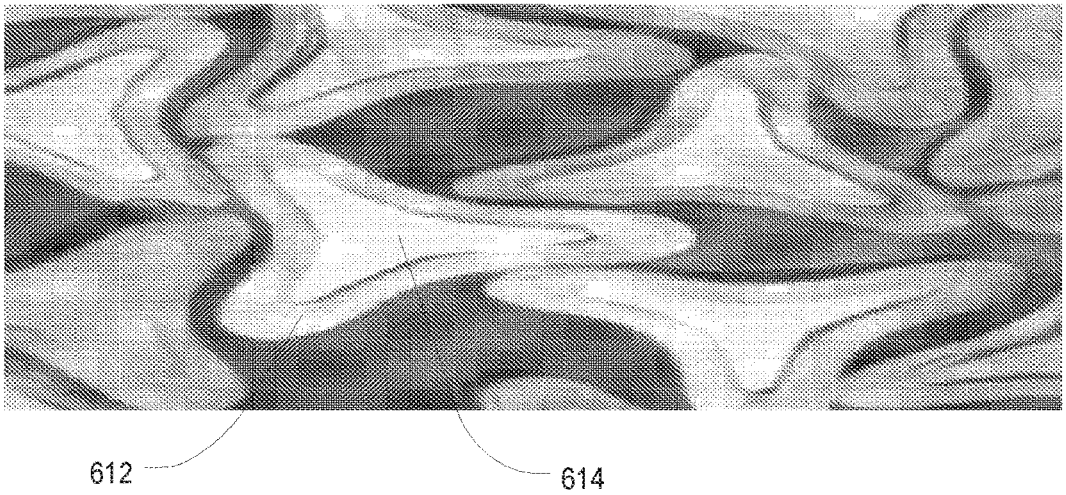
Figure 5C:
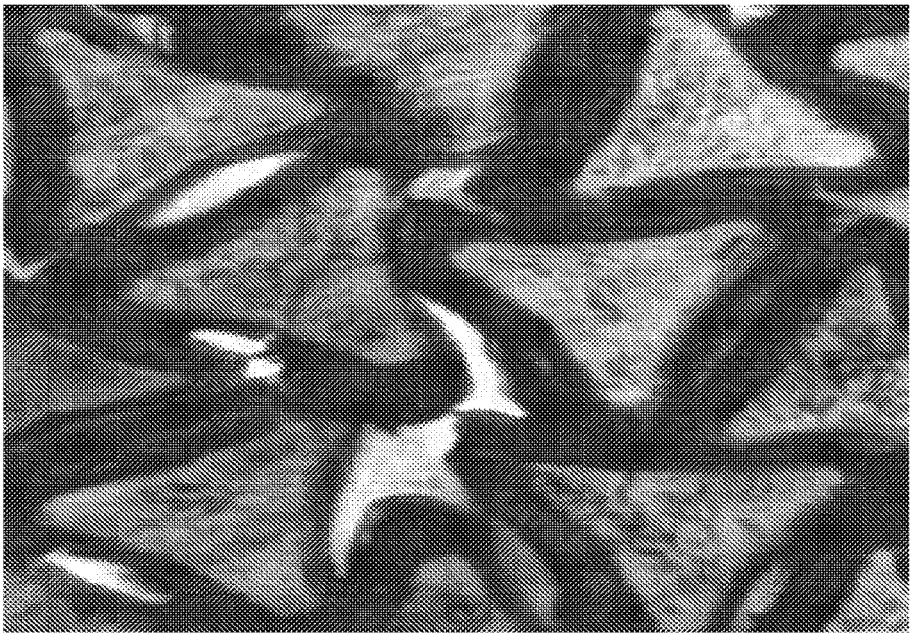
Figure 5D:
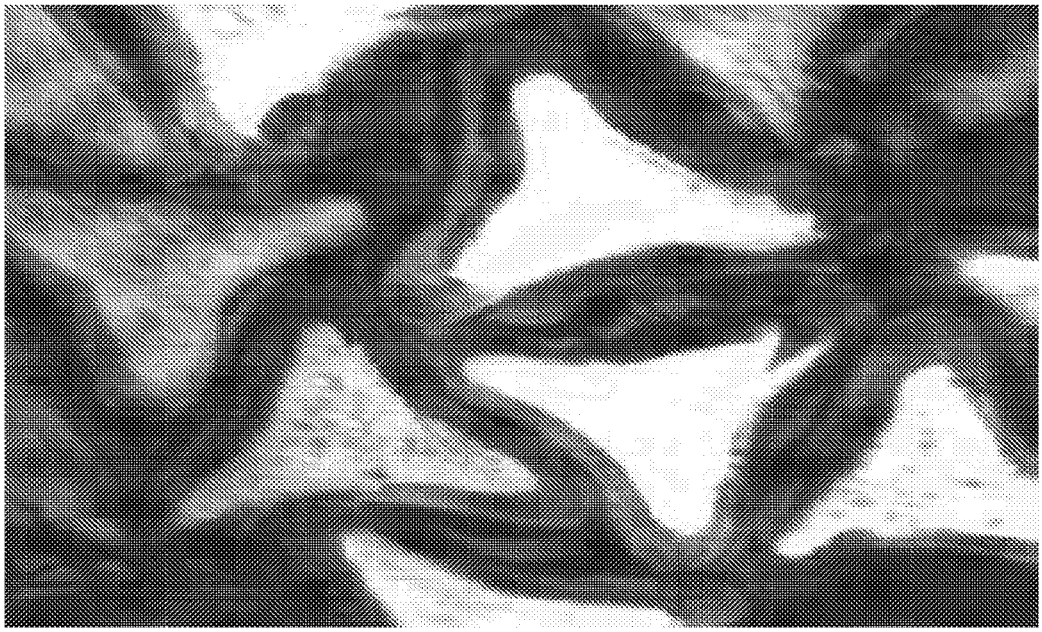

Each of FIGS. 5B-5D likewise depicts a cross-sectional view of bi-component continuous filament, with a tri-lobal cross-sectional shape, having a sheath formed of a polyamide that includes nylon 6 and a core formed of a polyester that includes polyethylene terephthalate (PET). The percentage of each polymer component relative to the whole varies across the three samples, as presented in the second column of Table 1. Each of the samples of FIGS. 5B-5D was prepared using a binding agent as described above.

The test data associated with the images of FIGS. 5A-5D are summarized below in Table 1. Industry standard ASTM D-2256 was used to identify the elongation and tenacity, ASTM D-2259 was to measure boiling water shrinkage, and ASTM D-6774 was used to measure crimp contraction.

TABLE 1

| Image | Bi-component filament | Denier/ Filament | Elongation (%) | Tenacity (gpd) | Boiling Water Shrinkage (%) | Crimp Contraction (%) |
|---|---|---|---|---|---|---|
| FIG. 5A | Nylon 6/PET (no Binding Agent) | 1200/60 | 37.88 | 3 | 2.5 | 20.41 |
| FIG. 5B | Nylon 6/PET (50/50) (with Binding Agent) | 1200/60 | 37.64 | 3.85 | 1.25 | 20.58 |
| FIG. 5C | Nylon 6/PET (33/67) (with Binding Agent) | 1200/60 | 35.39 | 3.39 | 0.92 | 19.27 |
| FIG. 5D | Nylon 6/PET (67/33) (with Binding Agent) | 1200/60 | 33.61 | 3.55 | 1.81 | 21.64 |

As summarized in Table 1, the bi-component continuous filament samples of FIGS. 5B-5D exhibit higher tenacity levels (i.e., strength) than the bi-component continuous filament sample of FIG. 5A, which was prepared without a binding agent. As further shown in Table 1, the bi-component continuous filament samples of FIGS. 5B-5D maintain relatively high elongation percent in conjunction with increased tenacity. Accordingly, the bi-component continuous filament samples of FIGS. 5B-5D support an increase in overall strength with the use of a binding agent as described above. It is noted that ASTM D-2256, an industry standard for measuring tensile of yarn by the single-strand method, was used to identify the tenacity and elongation.

Furthermore, with reference to FIG. 5A (and by comparison of FIG. 5A with FIGS. 5B-5D), some bi-component continuous filaments of FIG. 5A exhibit delamination between the sheath 512 and the core 514. In particular, FIG. 5A illustrates that gaps 518 have already formed between the sheath 512 and the core 514, where the polymer components are no longer adhered to one another. In FIG. 5B (as well as FIGS. 5C and 5D), by comparison, the bi-component continuous filaments exhibit a high degree of lamination, with little to no gaps, where the binding agent has effectively bound the sheath 612 and the core 614 together along their respective lengths.

In addition to the test data corresponding to FIGS. 5A-5D, additional samples with tri-lobal cross-sections were tested to explore compositions to further increase performance. More specifically, a study was conducted to explore compositions and the effects of composition on the elongation and tenacity of the bi-component continuous filaments. In this experiment, the ratio of the materials used in the bi-component continuous filament's core and sheath was examined. ASTM D-2256, an industry standard for measuring tensile of yarn by the single-strand method, was used to identify the tenacity and elongation. ASTM D-2259 was to measure boiling water shrinkage. ASTM D-6774 was used to measure crimp contraction. The test data associated with the additional study are summarized below in Table 2.

TABLE 2

| Denier/ Filament | Polymer (core/ sheath) | Real Denier ±1.5% | Elongation (%) ±5 | Crimp Tenacity (gpd) ±0.2 | Contraction(%) ±2 | Boiling Water Shrinkage (%) ±0.2 | Nips (per meter) ±2 | Oil Pick Up (%) ±0.2 |
|---|---|---|---|---|---|---|---|---|
| 1200/60 | 60% PP + 40% PA6 | 1202 | 54.0 | 2.0 | 13.2 | 4.3 | 27 | 1.0 |
| 1200/60 | 70% PET + 30% PA6 | 1213 | 52.7 | 2.9 | 14.6 | 1.3 | 26 | 0.9 |
| 1550/60 | 70% PET + 30% PA6 | 1555 | 45.4 | 2.5 | 14.2 | 1.2 | 26 | 1.0 |
| 1200/60 | 50% PA6 + 50% PET | 1203 | 52.7 | 2.9 | 9.8 | 3.7 | 26 | 0.9 |
| 1200/60 | 70% PET + 30% PA6 | 1203 | 53.0 | 2.8 | 9.6 | 3.9 | 25 | 0.9 |
| 1200/60 | 70% PET + 30% PA6 | 1205 | 50.0 | 2.8 | 12.1 | 1.8 | 27 | 0.9 |
| 1200/60 | 70% PET + 30% PA6 | 1200 | 52.7 | 2.8 | 13.0 | 1.6 | 29 | 0.9 |
| 1200/60 | 70% PET + 30% PA6 | 1203 | 56.8 | 3.3 | 15.9 | 3.4 | 28 | 0.9 |
| 1550/60 | 70% PET + 30% PA6 | 1554 | 50.4 | 3.2 | 18.1 | 1.6 | 26 | 0.0 |
| 1550/60 | 70% PET + 30% PA6 | 1550 | 45.6 | 3.1 | 18.6 | 1.7 | 26 | 1.1 |
| 1200/60 | 70% PET + 30% PA6 | 1203 | 46.1 | 3.2 | 15.6 | 3.7 | 26 | 1.1 |
| 1550/60 | 70% PET + 30% PA6 | 1554 | 45.7 | 3.2 | 18.7 | 1.7 | 26 | 1.0 |
| 1200/60 | 70% PET + 30% PA6 | 1204 | 43.5 | 3.1 | 16.5 | 1.7 | 25 | 1.2 |
| 1200/60 | 70% PET + 30% PA6 | 1204 | 42.9 | 2.7 | 14.4 | 2.8 | 25 | 1.3 |
| 1200/60 | 70% PET + 30% PA6 | 1204 | 44.5 | 2.8 | 14.3 | 3.1 | 26 | 1.1 |
| 1200/60 | 70% PET + 30% PA6 | 1204 | 41.6 | 2.7 | 15.0 | 2.8 | 28 | 1.1 |
| 1200/60 | 70% PET + 30% PA6 | 1204 | 41.1 | 2.6 | 14.8 | 2.6 | 28 | 1.1 |
| 1200/60 | 50% PP + 50% PA6 | 1204 | 60.4 | 2.2 | 9.2 | 5.2 | 27 | 1.1 |
| 1200/60 | 50% PP + 50% PA6 | 1204 | 59.5 | 2.3 | 9.1 | 5.0 | 27 | 1.0 |
| 1200/60 | 50% PP + 50% PA6 | 1204 | 57.1 | 2.1 | 8.9 | 4.9 | 27 | 0.9 |
| 1200/60 | 50% PP + 50% PA6 | 1204 | 55.5 | 2.5 | 8.9 | 4.9 | 27 | 0.8 |
| 1200/60 | 50% PP + 50% PA6 | 1204 | 52.2 | 2.1 | 9.1 | 4.2 | 28 | 0.9 |
| 1200/60 | 50% PET + 50% PA6 | 1204 | 52.6 | 3.2 | 14.0 | 2.8 | 28 | 1.0 |
| 1200/60 | 50% PET + 50% PA6 | 1210 | 56.6 | 3.1 | 14.6 | 2.7 | 28 | 1.1 |
| 1900/60 | 50% PET + 50% PA6 | 1908 | 49.2 | 2.9 | 19.2 | 2.6 | 28 | 1.0 |
| 1900/60 | 50% PET + 50% PA6 | 1898 | 51.0 | 2.9 | 18.6 | 3.0 | 28 | 1.2 |
| 1200/60 | 50% PET + 50% PA6 | 1206 | 54.6 | 3.2 | 14.9 | 2.9 | 29 | 1.3 |

TABLE 2-continued

| Denier/ Filament | Poly-mer (core/ sheath) | Real Denier ±1.5% | Elong-ation (%) ±5 | Crimp Tenacity (gpd) ±0.2 | Contrac-tion(%) ±2 | Boiling Water Shrink-age (%) ±0.2 | Nips (per meter) ±2 | Oil Pick Up (%) ±0.2 |
|---|---|---|---|---|---|---|---|---|
| 1200/60 | 50% PET + 50% PA6 | 1204 | 56.7 | 3.0 | 14.5 | 2.3 | 29 | 1.1 |
| 1900/60 | 50% PET + 50% PA6 | 1899 | 52.0 | 2.9 | 18.5 | 2.7 | 27 | 1.1 |
| 1900/60 | 50% PET + 50% PA6 | 1895 | 48.4 | 2.8 | 19.3 | 2.7 | 28 | 1.1 |
| 1200/60 | 50% PET + 50% PA6 | 1230 | 51.3 | 3.1 | 14.6 | 2.8 | 27 | 1.1 |
| 1200/60 | 50% PBT + 50% PA6 | 1204 | 52.6 | 3.2 | 14.0 | 2.8 | 28 | 1.0 |
| 1200/60 | 60% PBT + 40% PA6 | 1210 | 56.0 | 3.1 | 14.6 | 2.7 | 28 | 0.9 |
| 1900/60 | 50% PBT + 50% PA6 | 1908 | 48.0 | 2.9 | 19.2 | 2.6 | 28 | 1.1 |
| 1900/60 | 50% PBT + 50% PA6 | 1898 | 51.0 | 2.9 | 18.6 | 3.0 | 28 | 1.0 |
| 1200/60 | 50% PET + 50% PBT | 1206 | 54.6 | 3.2 | 14.9 | 2.9 | 29 | 1.2 |
| 1200/60 | 50% PET + 50% PBT | 1204 | 56.7 | 3.0 | 14.5 | 2.7 | 29 | 1.3 |
| 1900/60 | 60% PET + 40% PBT | 1899 | 52.0 | 2.9 | 18.5 | 3.1 | 27 | 1.1 |
| 1900/60 | 70% PET + 30% PBT | 1895 | 48.4 | 2.8 | 19.3 | 2.7 | 28 | 1.1 |
| 1200/60 | 50% PET + 50% PA6 | 1230 | 51.3 | 3.1 | 14.6 | 3.0 | 27 | 1.1 |
| 1200/60 | 50% Recycle PET + 50% PA6 | 1204 | 52.6 | 3.2 | 15.7 | 2.8 | 28 | 1.1 |
| 1200/60 | 50% Recycle PET + 50% PA6 | 1210 | 56.6 | 3.1 | 16.9 | 2.7 | 28 | 1.0 |
| 1900/60 | 50% Recycle PET + 50% PA6 | 1908 | 49.2 | 2.9 | 19.2 | 2.6 | 27 | 1.0 |
| 1900/60 | 50% Recycle PET + 50% PA6 | 1898 | 52.2 | 2.9 | 18.6 | 3.0 | 25 | 1.0 |
| 1200/60 | 50% PET + 50% Recycle PA6 | 1204 | 53.4 | 3.2 | 14.0 | 2.7 | 27 | 0.9 |
| 1200/60 | 50% PET + 50% Recycle PA6 | 1210 | 56.6 | 3.3 | 14.6 | 2.7 | 28 | 0.9 |
| 1900/60 | 50% PET + 50% Recycle PA6 | 1908 | 48.2 | 2.9 | 18.4 | 2.5 | 29 | 1.0 |
| 1900/60 | 50% PET + 50% Recycle PA6 | 1898 | 51.0 | 2.9 | 18.6 | 3.3 | 28 | 0.9 |
| 1200/60 | 50% PA6 + 50% PBT | 1204 | 52.6 | 3.2 | 15.0 | 2.8 | 28 | 1.1 |
| 1200/60 | 50% PA6 + 50% PBT | 1210 | 56.0 | 3.1 | 16.9 | 2.7 | 28 | 1.0 |
| 1900/60 | 50% PA6 + 50% PBT | 1908 | 48.0 | 2.9 | 19.2 | 2.6 | 28 | 1.2 |
| 1900/60 | 50% PA6 + 50% PBT | 1898 | 51.0 | 2.8 | 17.5 | 3.0 | 28 | 1.1 |
| 1200/60 | 50% PP + 50% PBT | 1204 | 60.4 | 2.3 | 9.2 | 5.2 | 26 | 1.1 |
| 1200/60 | 50% PP + 50% PBT | 1204 | 59.5 | 2.3 | 11.0 | 5.0 | 27 | 1.0 |
| 1200/60 | 50% PP + 50% PBT | 1204 | 57.1 | 2.1 | 8.9 | 4.9 | 28 | 0.9 |

TABLE 2-continued

| Denier/ Filament | Polymer (core/ sheath) | Real Denier ±1.5% | Elongation (%) ±5 | Crimp Tenacity (gpd) ±0.2 | Contraction(%) ±2 | Boiling Water Shrinkage (%) ±0.2 | Nips (per meter) ±2 | Oil Pick Up (%) ±0.2 |
|---|---|---|---|---|---|---|---|---|
| 1200/60 | 50% PP + 50% PBT | 1204 | 55.5 | 1.9 | 9.6 | 4.9 | 27 | 0.8 |
| 1200/93 | 70% PET + 30% PA6 | 1203 | 53.0 | 3.2 | 9.6 | 3.9 | 25 | 0.9 |
| 1200/93 | 70% PET + 30% PA6 | 1205 | 50.0 | 3.5 | 12.1 | 1.8 | 27 | 0.9 |
| 1200/93 | 70% PET + 30% PA6 | 1200 | 52.7 | 2.8 | 13.0 | 1.6 | 29 | 0.9 |
| 1200/93 | 70% PET + 30% PA6 | 1203 | 56.8 | 3.3 | 15.9 | 3.4 | 28 | 0.9 |

In at least some embodiments, either or both of the first and second polymer components of bi-component continuous filaments 10, 110, 210, 310 is solution dyed (i.e., dope-dyed) or hank dyed to enhance certain physical attributes of the resulting bi-component continuous filaments. Because many polymers are initially color-free (i.e., raw white), polymers can be treated using a solution dyeing process prior to spinning a bi-component continuous filament or using a hank dyeing process after spinning a bi-component continuous filament. With solution dyeing, the polymer components themselves can be permeated with a desired pigment via solution dyeing so that the color exists in the extruded polymer mix. Filaments prepared using a solution dyeing process have demonstrated enhanced ability to retain color (i.e., color fastness). With hank dyeing, the polymer filaments are permeated with a dye and then finished (e.g., steamed) to fix the dye. Filaments prepared with a hank dyeing process allow manufactures to maintain an inventory of undyed yarns and decrease lead times for special color orders. Filaments prepared using a hank dyeing process have demonstrated richer color vibrancy than other methods.

In one contemplated form of solution dyeing usable to generate bi-component continuous filaments 10, 110, 210, 310 in accordance with one or more aspects of the present disclosure, the solution is prepared using a pigment dyestuff to add a desired color to the polymer mix. Here, the pigment is typically a pure color pigment that is added during the melt stage and extruded with either or both polymer components to deliver a spun filament exhibiting the selected color. It is contemplated that the pigment can be in an organic or an inorganic form, as might be desired. In many cases, use of a pure color pigment in connection with solution dyeing results in filaments with strong, vivid color, although a range of color variability (i.e., subtle changes of hues) can sometimes be difficult to achieve.

In another contemplated form of solution dyeing usable to generate bi-component continuous filaments 10, 110, 210, 310 in accordance with one or more aspects of the present disclosure, the solution is prepared using each of a pigment dyestuff and a solvent. A solvent added to the solution dyeing process can introduce added strength to an extruded polymer. In addition, inclusion of a solvent can facilitate enhanced color variability. In other words, the solvent can often the effect of the pure color pigment, standing alone, so that a wider range of color shades and hues can be obtained in an extruded polymer.

It is contemplated that either the first component, the second component or both the first and second components can be treated via a solution dyeing process. Furthermore, it is contemplated that, to the extent that a natural white color is preferred, neither the first polymer component nor the second polymer component is solution dyed so as to preserve the raw white characteristic of color-free polymer. In a preferred embodiment, each of the first and second polymer components is solution dyed prior to extrusion-either using a pigment alone or using a pigment in combination with a solvent. In this regard, it is contemplated that each of the first and second polymer components can be treated using the same solution dyeing process (i.e., using the same solvent and/or pigment) or using a different solution dyeing processes (i.e., using different solvents and/or pigments for each polymer component). In this latter regard, a resultant bi-component continuous filament 10, 110, 210, 310 can exhibit a sheath of one color and a core of a different color.

In one contemplated form of hank dyeing usable to generate bi-component continuous filaments 10, 110, 210, 310 in accordance with one or more aspects of the present disclosure, the bi-component continuous filaments are spun into yarns and submerged in a dye bath to add a desired color to the polymer mix. Here, the dye bath is formulated based on the polymer material that is being used. For example, if the sheath of the bi-component continuous filament is polyester (PET), the dye bath may be prepared with a disperse dye. In another example, if the sheath of the bi-component continuous filament is polyamide, the dye bath may be prepared with an acid dye.

It is contemplated that many polymer materials may be used to create the bi-component continuous filament described herein and that the hank dyeing process should be determined based on the polymer material and the appropriate dyestuff for that polymer.

In at least some embodiments, it is contemplated that in either or both of the first and second polymer components of bi-component continuous filaments 10, 110, 210, 310, functional additives may be added to the first and/or second polymer component to achieve desirable properties, including (but not limited to): fire retardancy, fire resistance, antimicrobial, antibacterial, antifungal, and anti-staining properties. As used herein, the term "functional additive" includes materials added to the polymer itself and materials added to a finish used to coat or otherwise treat the bi-component continuous filaments. It is contemplated that the functional additives may be incorporated into the bi-component continuous filament as a copolymer during the polymerization process, during extrusion, or as a finish after fiber or yarn formation. It is contemplated that any known, commercially available functional additive that is suitable for use with the polymer materials implemented may be used to achieve the desirable properties. For example, reactive and additive fire retardants may be used; including: minerals, organohalogen compounds, organophosphorus compounds, and organic compounds. For example, to achieve antimicrobial, antibacterial, or antifungal properties, additives such as isothiazolinone treatments, zinc pyrithione, thiabendazole and silver may be implemented. For example, to achieve anti-staining properties, additives known to alter polymers to increase (or decrease) the polymer's hydrophobic and/or olephobic properties, or to lower the surface energy of the polymer may be implemented.

Figure 6:
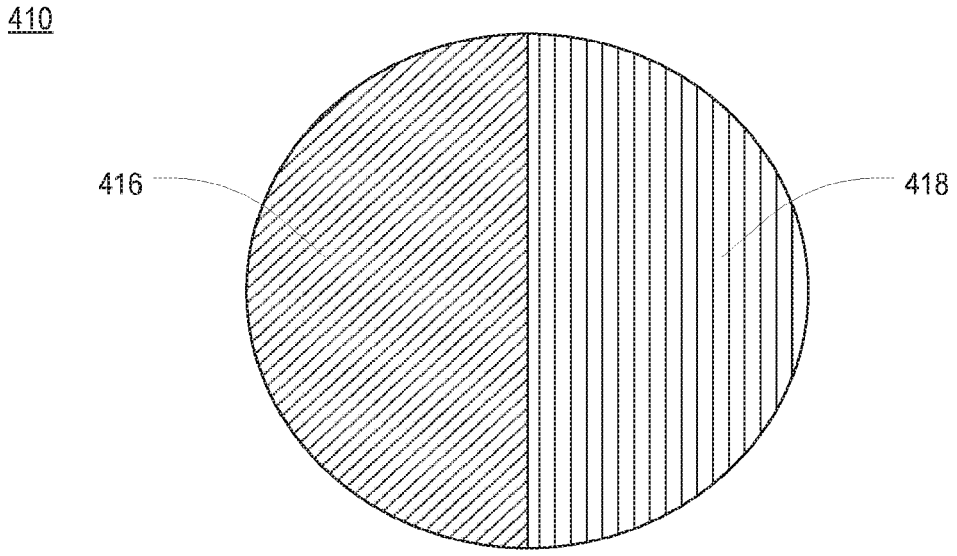
FIG. 6 is a schematic cross-sectional view of an embodiment of a bi-component continuous filament, in accordance with one or more aspects of the present disclosure, depicting the bi-component filament as having a circular cross-sectional shape with the polymer components in a side-by-side relationship.

Turning now to FIG. 6, a schematic cross-sectional view of an embodiment of a bi-component filament 410, in accordance with one or more aspects of the present disclosure, is shown. Here, the bi-component continuous filament 410 has a generally circular cross-sectional shape with the polymer components arranged in a side-by-side relationship. As shown in FIG. 6, bi-component filaments in accordance with one or more aspects of the present disclosure are not limited to the polymer components being arranged in a sheath-core relationship. In FIG. 6, two different polymer components 416, 418 are shown side-by-side, and adhered together, to form a single bi-component continuous filament 410 having a generally circular cross-sectional shape. It should be noted that, though the bi-component continuous filament 410 of FIG. 6 is depicted as having a generally circular cross-sectional shape, filaments with non-circular cross-sectional shapes (e.g., elliptical, tri-lobal, and the like) are likewise contemplated. Furthermore, in at least some contemplated embodiments, a bi-component continuous filament with polymer components arranged in a side-by-side relationship, as in FIG. 6, can be symmetrically arranged. In other contemplated embodiments, a bi-component continuous filament with polymer components arranged in a side-by-side relationship can be asymmetrically arranged.

Although not specifically depicted here, it is further contemplated that the polymer components of bi-component continuous filaments in accordance with one or more aspects of the present disclosure may exhibit matrix-fibril type structure, whereby filaments of one polymer component are dispersed in a matrix made using another polymer component, or the polymer components of bi-component continuous filaments in accordance with one or more aspects of the present disclosure may be arranged in a segmented pie-chart (or citrus) type structure. It is contemplated that these other types of bi-component continuous filament arrangements can have circular or non-circular arrangements, as might be preferred. It is further contemplated that these other types of bi-component filament arrangements can have symmetrical or asymmetrical arrangements, as might be preferred.

In a contemplated method of generating bi-component continuous filaments 10, 110, 210, 310, 410 in accordance with one or more aspects of the present disclosure, the first and second polymer components, are selected for inclusion in a bi-component continuous filament. Though the polymer components often exist in a chip or pellet form, other forms of polymer components are contemplated. In a contemplated method, the first and second polymer components are mixed independently of one another. A binding agent, as described hereinabove, can be included in the polymer mix of one or both of the first and/or second polymer components. In a contemplated embodiment, the binding agent is mixed with the second polymer component, which, in FIGS. 1-4, forms the core of the resulting bi-component continuous filament.

Either or both of the and second polymer components can be solution dyed prior to spinning or hank dyed after spinning. In contemplated embodiments, the solution dyeing process includes a pigment or each of a pigment and a solvent. It is contemplated that solution dyeing the polymer components prior to spinning enables coloration of the polymer components (across a wide spectrum of colors, particularly when a solvent is included in the solution dyeing process). The solution-dyeing process can also enhance strength and durability in the polymer components so as to impart the resulting bi-component continuous filament with desirable attributes for various end-use applications.

Each polymer mix is heated and stirred so that each of the first and second polymer components forms a melt that is ready for extrusion via a spinneret. The first and second polymer melts are fed through a spinneret selected to yield a bi-component continuous filament 10, 110, 210, 310, 410 of a particular cross-sectional shape. After spinning, the resulting bi-component filament 10, 110, 210, 310, 410 can be further treated and/or texturized for implementation across a wide range of different end-use applications. The resulting filament further can be heat set, including, but not limited to, dry heat setting, steam heat setting, or a combination of both.

It is further contemplated that the resulting bi-component continuous filament 10, 110, 210, 310, 410 can be texturized to form bulk continuous filament suitable for tufting and weaving into floor coverings, such as carpets, or other textile products where durability, strength and/or color-fastness may be advantageous. In further preparation for end-use applications, bulk continuous filament bundles of the bi-component continuous filaments 10, 110, 210, 310, 410 can be intermingled with two or three bundles of the same color or a different color.

Additionally, or alternatively, the resulting bi-component continuous filament 10, 110, 210, 310, 410 can be cable formed, whereby the filaments exhibit a pile construction with chunky tufts and longer pile height, or twist and heat set formed, whereby the filaments are twisted together and then heat set to help the twisted bundle stay intact and increase resistance to pile crush. Where bi-component continuous filaments are twisted, it is contemplated that single or multiple bundles of bulk continuous filaments (e.g., one, two or three bundles) of the same or different color can be twisted to satisfy the demands of various end-use applications. In this regard, it is contemplated that twisting can range from zero turns per meter up to approximately 300 turns per meter. Likewise, where bi-component continuous filaments are heat set, it is contemplated that single or multiple bundles of bulk continuous filaments (e.g., one, two or three bundles) of the same or different color can be heat set to satisfy the demands of various end-use applications. Heat setting can afford the filaments with enhanced dimensional stability as well as other desirable attributes, such as wrinkle resistance and/or temperature resistance. It is contemplated that heat setting can be accomplished by steam heating, by dry heating or by a combination of steam and dry heating.

It is further contemplated that bulk continuous filaments yarn may be generated using bi-component filaments 10, 110, 210, 310, 410 in accordance with one or more aspects of the present disclosure exhibits a denier per filament (DPF) ratio measuring from approximately 2 DPF to approximately 50 DPF. Furthermore, it is contemplated that bulk continuous filament yarns generated using bi-component continuous filaments 10, 110, 210, 310, 410 in accordance with one or more aspects of the present disclosure exhibits a weight measuring between approximately 500 denier to approximately 3500 denier.

Bi-component continuous filaments 10, 110, 210, 310, 410 in accordance with one or more aspects of the present disclosure have broad utility across a range of end-use textile applications. In at least some embodiments, a polyamide sheath can provide a good visual appeal to pile change and, as such, the bi-component continuous filament is well-suited for use in floor covering products. Furthermore, in at least some embodiments, a polyester or a polyolefin (e.g., polypropylene) core can provide enhanced moisture-repelling properties so that textile products incorporating such filaments are more durable and are quick-drying.

It is contemplated that, bi-component continuous filaments 10, 110, 210, 310, 410 and bi-component continuous filament yarns in accordance with one or more aspects of the present disclosure can be woven for production of any of a wide range of floor and surface coverings, including, but not limited to, door mats, bath rugs, area rugs, accent rugs, carpet tile rugs, broadloom carpet, automotive floor mats, automotive covering, automotive internal floor covering. It is further contemplated that bi-component continuous filaments 10, 110, 210, 310, 410 and bi-component continuous filament yarns in accordance with one or more aspects of the present disclosure may likewise be implemented in textile products such as sheeting, towels and other bed and bathroom textile needs.

EXAMPLES

It is contemplated that the examples discussed below may be implemented with respect to any of the bi-component continuous filament shapes and/or arrangements discussed above.

Example 1

In one contemplated bi-component continuous filament in accordance with one or more aspects of the present disclosure, first and second polymer components of the bi-component continuous filament are arranged in a sheath-core relationship. In this example, each of the first polymer component (i.e., the sheath) and the second polymer component (i.e., the core) is solution dyed during or prior to the extrusion process. The solution-dyeing process in this example includes: (a) solution dyeing with a pigment (using a pigment in either an organic or an inorganic form); or (b) solution dyeing with a combination of a pigment and a solvent.

In Example 1, it is contemplated that the first polymer component (i.e., the sheath) includes a polyamide, a polyolefin, or a polyester. The polyamide includes, for example, nylon 6. The polyolefin includes, for example, polypropylene (PP). The polyester includes, for example, polyethylene terephthalate (PET), polybutylene terephthalate (PBT), or polytrimethylene terephthalate (PTT).

Furthermore, in Example 1, it is contemplated that the second polymer component (i.e., the core) includes a polyamide, a polyolefin, or a polyester. The polyamide includes, for example, nylon 6. The polyolefin includes, for example, polypropylene (PP). The polyester includes, for example, polyethylene terephthalate (PET), polybutylene terephthalate (PBT), or polytrimethylene terephthalate (PTT).

Example 2

In another contemplated bi-component continuous filament in accordance with one or more aspects of the present disclosure, first and second polymer components of the bi-component filament are arranged in a sheath-core relationship. Although not required, one or both of the first polymer component (i.e., the sheath) and the second polymer component (i.e., the core) are solution dyed during or prior to the extrusion process. The solution-dyeing process in this example includes: (a) solution dyeing with a pigment (using a pigment in either an organic or an inorganic form); or (b) solution dyeing with a combination of a pigment and a solvent. Alternatively, it is contemplated that each of the first polymer component and the second polymer can be color-free (i.e., raw white). It is further contemplated that the first polymer component (i.e. the sheath) can be solution dyed in accordance with one of the above-described processes, while the second polymer component (i.e., the core) is color-free, or that the second polymer component (i.e., the core) can be solution dyed in accordance with one of the above-described processes, while the first polymer component (i.e., the sheath) is color-free.

In Example 2, a binding agent is mixed with one or both of the and second polymer components. As the polymers are extruded into the bi-component continuous filament, the binding agent facilitates strong adhesion qualities between the first and second polymer components. The binding agent includes, for example, a polyolefin modified by maleic anhydride.

Furthermore, in Example 2, it is contemplated that the first polymer component (i.e., the sheath) includes a polyamide, a polyolefin, or a polyester. The polyamide includes, for example, nylon 6. The polyolefin includes, for example, polypropylene (PP). The polyester includes, for example, polyethylene terephthalate (PET), polybutylene terephthalate (PBT), or polytrimethylene terephthalate (PTT).

Furthermore, in Example 2, it is contemplated that the second polymer component (i.e., the core) includes a polyamide, a polyolefin, or a polyester. The polyamide includes, for example, nylon 6. The polyolefin includes, for example, polypropylene (PP). The polyester includes, for example, polyethylene terephthalate (PET), polybutylene terephthalate (PBT), or polytrimethylene terephthalate (PTT).

Example 3

In another contemplated bi-component continuous filament in accordance with one or more aspects of the present disclosure, first and second polymer components of the bi-component filament are arranged in a sheath-core relationship. In this example, each of the first polymer component (i.e., the sheath) and the second polymer component (i.e., the core) is solution dyed during or prior to the extrusion process. The solution-dyeing process in this example includes: (a) solution dyeing with a pigment (using a pigment in either an organic or an inorganic form); or (b) solution dyeing with a combination of a pigment and a solvent.

In Example 3, it is contemplated that the first polymer component (i.e., the sheath) includes a polyamide in cationic form, a polyolefin in cationic form, or a polyester in cationic form The polyamide includes, for example, a cationic form of nylon 6. The polyolefin includes, for example, a cationic form of polypropylene (PP). The polyester includes, for example, a cationic form of polyethylene terephthalate (PET), a cationic form of polybutylene terephthalate (PBT), or a cationic form of polytrimethylene terephthalate (PTT).

Furthermore, in Example 3, it is contemplated that the second polymer component (i.e., the core) includes a polyamide, a polyolefin, or a polyester. The polyamide includes, for example, nylon 6. The polyolefin includes, for example, polypropylene (PP). The polyester includes, for example, polyethylene terephthalate (PET), polybutylene terephthalate (PBT), or polytrimethylene terephthalate (PTT).

Example 4

In still another contemplated bi-component continuous filament in accordance with one or more aspects of the present disclosure, first and second polymer components of the bi-component filament are arranged in a sheath-core relationship. Although not required, one or both of the first polymer component (i.e., the sheath) and the second polymer component (i.e., the core) can be solution dyed during or prior to the extrusion process. The solution-dyeing process in this example includes: (a) solution dyeing with a pigment (using a pigment in either an organic or an inorganic form); or (b) solution dyeing with a combination of a pigment and a solvent. Alternatively, it is contemplated that each of the first polymer component and the second polymer can be color-free (i.e., raw white). It is further contemplated that the first polymer component (i.e. the sheath) can be solution dyed in accordance with one of the above-described processes, while the second polymer component (i.e., the core) is color-free, or that the second polymer component (i.e., the core) can be solution dyed in accordance with one of the above-described processes, while the first polymer component (i.e., the sheath) is color-free.

In Example 4, a binding agent is mixed with one or both of the and second polymer components. As the bi-component continuous filament is extruded, the binding agent facilitates strong adhesion qualities between the first and second polymer components. The binding agent includes, for example, a polyolefin modified by maleic anhydride.

Furthermore, in Example 4, it is contemplated that the first polymer component (i.e., the sheath) includes a polyamide, a polyolefin, or a polyester. The polyamide includes, for example, nylon 6. The polyolefin includes, for example, polypropylene (PP). The polyester includes, for example, polyethylene terephthalate (PET), polybutylene terephthalate (PBT), or polytrimethylene terephthalate (PTT).

Furthermore, in Example 4, it is contemplated that the second polymer component (i.e., the core) includes a recycled polyamide or a recycled polyester. The polyamide includes, for example, a recycled form of nylon 6. The polyester includes, for example, a recycled form of polyethylene terephthalate (PET).

Example 5

In another contemplated bi-component continuous filament in accordance with one or more aspects of the present disclosure, first and second polymer components of the bi-component filament are arranged in a sheath-core relationship. Although not required, one or both of the first polymer component (i.e., the sheath) and the second polymer component (i.e., the core) are hank dyed after the extrusion process. Alternatively, it is contemplated that each of the first polymer component and the second polymer can be color-free (i.e., raw white).

In Example 5, a binding agent is mixed with one or both of the and second polymer components. As the polymers are extruded into the bi-component continuous filament, the binding agent facilitates strong adhesion qualities between the first and second polymer components. The binding agent includes, for example, a polyolefin modified by maleic anhydride.

Furthermore, in Example 5, it is contemplated that the first polymer component (i.e., the sheath) includes a polyamide, a polyolefin, or a polyester. The polyamide includes, for example, nylon 6. The polyolefin includes, for example, polypropylene (PP). The polyester includes, for example, polyethylene terephthalate (PET), polybutylene terephthalate (PBT), or polytrimethylene terephthalate (PTT). Furthermore, in Example 5, it is contemplated that the second polymer component (i.e., the core) includes a polyamide, a polyolefin, or a polyester. The polyamide includes, for example, nylon 6. The polyolefin includes, for example, polypropylene (PP). The polyester includes, for example, polyethylene terephthalate (PET), polybutylene terephthalate (PBT), or polytrimethylene terephthalate (PTT).

Example 6

In another contemplated bi-component continuous filament in accordance with one or more aspects of the present disclosure, first and second polymer components of the bi-component continuous filament are arranged in a sheath-core relationship. It is contemplated that either or both of the polymers may be dyed or have a functional additive added.

In Example 6, it is contemplated that the first polymer component (i.e., the sheath) includes a polyamide, a polyolefin, or a polyester. Furthermore, in Example 6, it is contemplated that the second polymer component (i.e., the core) includes a polyamide, a polyolefin, or a polyester. It is further contemplated that the ratio of the sheath material to the core material (calculated by weight) may be manipulated to lower the costs of producing an enhanced bi-component continuous filament by maintaining the desired denier while decreasing the percentage of the sheath or core material that contains a dye or functional additive. For example, it is contemplated that the core of the enhanced bi-component continuous filament could comprise polyester core that accounts for 70% of the filament's volume and a sheath that has a functional additive that accounts for 30%. By decreasing the volume of the sheath material, it is possible to optimize the desired properties and cost.

Turning now to FIG. 6, a schematic cross-sectional view of an embodiment of a bi-component filament 410, in accordance with one or more aspects of the present disclosure, is shown. Here, the bi-component continuous filament 410 has a generally circular cross-sectional shape with the polymer components arranged in a side-by-side relationship. As shown in FIG. 6, bi-component filaments in accordance with one or more aspects of the present disclosure are not limited to the polymer components being arranged in a sheath-core relationship. In FIG. 6, two different polymer components 416, 418 are shown side-by-side, and adhered together, to form a single bi-component continuous filament 410 having a generally circular cross-sectional shape. It should be noted that, though the bi-component continuous filament 410 of FIG. 6 is depicted as having a generally circular cross-sectional shape, filaments with non-circular cross-sectional shapes (e.g., elliptical, tri-lobal, and the like) are likewise contemplated. Furthermore, in at least some contemplated embodiments, a bi-component continuous filament with polymer components arranged in a side-by-side relationship, as in FIG. 6, can be symmetrically arranged. In other contemplated embodiments, a bi-component continuous filament with polymer components arranged in a side-by-side relationship can be asymmetrically arranged.

Although not specifically depicted here, it is further contemplated that the polymer components of bi-component continuous filaments in accordance with one or more aspects of the present disclosure may exhibit matrix-fibril type structure, whereby filaments of one polymer component are dispersed in a matrix made using another polymer component, or the polymer components of bi-component continuous filaments in accordance with one or more aspects of the present disclosure may be arranged in a segmented pie-chart (or citrus) type structure. It is contemplated that these other types of bi-component continuous filament arrangements can have circular or non-circular arrangements, as might be preferred. It is further contemplated that these other types of bi-component filament arrangements can have symmetrical or asymmetrical arrangements, as might be preferred. In a method of generating bi-component continuous filaments 10, 110, 210, 310, 410 in accordance with one or more aspects of the present invention, first and second polymer components, as described in connection with FIGS. 1-4 and 6, are selected for inclusion in a bi-component continuous filament. Though the polymer components often exist in a chip or pellet form, other forms of polymer components are contemplated. In a contemplated method, the first and second polymer components are mixed independently of one another. A binding agent, as described hereinabove, can be included in the polymer mix of one or both of the and second polymer components. In a contemplated embodiment, the binding agent is mixed with the second polymer component, which, in FIGS. 1-4, forms the core of the resulting bi-component continuous filament.

Either or both of the and second polymer components can be solution-dyed prior to spinning. In contemplated embodiments, the solution dyeing process includes a pigment or each of a pigment and a solvent. As discussed hereinabove, solution dyeing the polymer components prior to spinning enables coloration of the polymer components (across a wide spectrum of colors, particularly when a solvent is included in the solution dyeing process). The solution-dyeing process can also enhance strength and durability in the polymer components so as to impart the resulting bi-component filament with desirable attributes for various end-use applications.

Each polymer mix is heated and stirred so that each of the first and second polymer components forms a melt that is ready for extrusion via a spinneret. The first and second polymer melts are fed through a spinneret selected to yield a bi-component filament 10, 110, 210, 310, 410 of a particular cross-sectional shape. After spinning, the resulting bi-component filament 10, 110, 210, 310, 410 can be further treated and/or texturized for implementation across a wide range of different end-use applications. The resulting filament further can be heat set, including, but not limited to, dry heat setting, steam heat setting, or a combination of both.

In one contemplated embodiment, the resulting bi-component filament 10, 110, 210, 310, 410 can be texturized to form bulk continuous filament suitable for tufting and weaving into floor coverings, such as carpets, or other textile products where durability, strength and/or color-fastness may be advantageous. In further preparation for end-use applications, bulk continuous filament bundles of the bi-component continuous filaments 10, 110, 210, 310, 410 can be intermingled with two or three bundles of the same color or a different color.

Additionally, or alternatively, the resulting bi-component filament 10, 110, 210, 310, 410 can be cable formed, whereby the filaments exhibit a pile construction with chunky tufts and longer pile height, or twist and heat set formed, whereby the filaments are twisted together and then heat set to help the twisted bundle stay intact and increase resistance to pile crush. Where bi-component continuous filaments are twisted, it is contemplated that single or multiple bundles of bulk continuous filaments (e.g., one, two or three bundles) of the same or different color can be twisted to satisfy the demands of various end-use applications. In this regard, it is contemplated that twisting can range from zero turns per meter up to approximately 300 turns per meter. Likewise, where bi-component continuous filaments are heat set, it is contemplated that single or multiple bundles of bulk continuous filaments (e.g., one, two or three bundles) of the same or different color can be heat set to satisfy the demands of various end-use applications. Heat setting can afford the filaments with enhanced dimensional stability as well as other desirable attributes, such as wrinkle resistance and/or temperature resistance. It is contemplated that heat setting can be accomplished by steam heating, by dry heating or by a combination of steam and dry heating.

In contemplated embodiments, bulk continuous filament generated using bi-component filaments 10, 110, 210, 310, 410 in accordance with one or more aspects of the present invention exhibits a denier per filament (DPF) ratio measuring from approximately 2 DPF to approximately 30 DPF. Furthermore, in contemplated embodiments, bulk continuous filament generated using bi-component continuous filaments 10, 110, 210, 310, 410 in accordance with one or more aspects of the present invention exhibits a weight measuring between approximately 500 denier to approximately 3500 denier.

Bi-component filaments 10, 110, 210, 310, 410 in accordance with one or more aspects of the present invention have broad utility across a range of end-use textile applications. In at least some embodiments, a polyamide sheath can provide a good visual appeal to pile change and, as such, the bi-component filament is well-suited for use in floor covering products. Furthermore, in at least some embodiments, a polyester or a polyolefin (e.g., polypropylene) core can provide enhanced moisture-repelling properties so that textile products incorporating such filaments are more durable and are quick-drying.

In various contemplated embodiments, bi-component continuous filaments 10, 110, 210, 310, 410 in accordance with one or more aspects of the present invention can be woven for production of any of a wide range of floor and surface coverings, including, but not limited to, door mats, bath rugs, area rugs, accent rugs, carpet tile rugs, broadloom carpet, automotive floor mats, automotive covering, automotive internal floor covering. It is further contemplated that bi-component filaments 10, 110, 210, 310, 410 in accordance with one or more aspects of the present invention may likewise be implemented in textile products such as sheeting, towels and other bed and bathroom textile needs.

Based on the foregoing description, it will be readily understood by those persons skilled in the art that the embodiments of the present disclosure are susceptible of broad utility and application. Many embodiments and adaptations of the present disclosure other than those specifically described herein, as well as many variations, modifications, and equivalent arrangements, will be apparent from or reasonably suggested by the present disclosure and the foregoing descriptions thereof, without departing from the substance or scope of the present disclosure. Accordingly, while the present disclosure has been described herein in detail in relation to one or more preferred embodiments, it is to be understood that this disclosure is only illustrative and exemplary of the present disclosure and is made merely for the purpose of providing a full and enabling disclosure. The foregoing disclosure is not intended to be construed to limit the present disclosure or otherwise exclude any such other embodiments, adaptations, variations, modifications or equivalent arrangements, the present disclosure being limited only by the claims appended hereto and the equivalents thereof.

What is claimed is:

1. A bi-component continuous filament, comprising:

a first polymer component forming a sheath;

a second polymer component forming a core that is surrounded by the sheath, the second polymer component comprising a cationic polyamide or a cationic polyester; and a binding agent adhering the first polymer component to the second polymer component along a length of the filament, wherein an elongation of the bi-component continuous filament is between 35.4±5.0-60.4±5.0 percent, and wherein a tenacity of the bi-component continuous filament is between 2.0±0.2-3.9±0.2 grams per denier (GPD).

2. The bi-component continuous filament of claim 1, wherein the first polymer component comprises a polyamide, polyester, or polyolefin material.

3. The bi-component continuous filament of claim 1, wherein the first polymer component comprises a cationic polyamide or a cationic polyester.

4. The bi-component continuous filament of claim 1, wherein at least one of the first polymer component and the second polymer component comprises polyamide, wherein the polyamide comprises nylon 6; nylon 6,6; nylon 7; nylon 6, 10; nylon 6, 12; nylon 12; nylon 46; or nylon 1212.

5. The bi-component continuous filament of claim 1, wherein at least one of the first polymer component and the second polymer component comprises polyester, wherein the polyester comprises polyethylene terephthalate (PET), polybutylene terephthalate (PBT), or polytrimethylene terephthalate (PTT).

6. The bi-component continuous filament of claim 1, wherein at least one of the first polymer component or the second polymer component is solution dyed.

7. The bi-component continuous filament of claim 1, wherein the bi-component continuous filament is hank dyed.

8. The bi-component continuous filament of claim 1, wherein the bi-component continuous filament is raw white.

9. The bi-component continuous filament of claim 1, wherein the binding agent comprises polyethylene, ethylene-vinyl acetate, or polypropylene modified by maleic anhydride.

10. The bi-component continuous filament of claim 1, wherein the bi-component continuous filament has a cross-sectional shape which is circular, elliptical, trilobal, polygonal, or star-shaped.

11. The bi-component continuous filament of claim 1, wherein the core is arranged concentrically or eccentrically relative to the sheath.

12. The bi-component continuous filament of claim 1, wherein the bi-component continuous filament has a square cross-section.

13. The bi-component continuous filament of claim 1, wherein a functional additive is included in at least one of the first polymer component or the second polymer component.

14. The bi-component continuous filament of claim 1, wherein the bi-component continuous filament exhibits a denier per filament (DPF) ratio measuring from approximately 2 DPF to approximately 50 DPF.

15. The bi-component continuous filament of claim 1, wherein the bi-component continuous filament is comprised in a yarn measuring from approximately 500 to 3500 denier.

16. A bi-component continuous filament, comprising:

a first polymer component forming a sheath; and a second polymer component forming a core that is surrounded by the sheath, the second polymer component comprising a cationic polyamide or a cationic polyester, wherein an elongation of the bi-component continuous filament is between 35.4±5.0-60.4±5.0 percent, and wherein a tenacity of the bi-component continuous filament is between 2.0±0.2-3.9±0.2 grams per denier (GPD).

17. The bi-component continuous filament of claim 16, wherein the first polymer component comprises the same polymer as the second polymer component.

18. The bi-component continuous filament of claim 16, wherein one of the first polymer component and the second polymer component comprises recycled polymer, and the other comprises virgin polymer.

19. The bi-component continuous filament of claim 16, wherein the first polymer component and the second polymer component comprise recycled polymer.

20. The bi-component continuous filament of claim 16, wherein the first polymer component and the second polymer component comprise virgin polymer.

21. The bi-component continuous filament of claim 16, wherein the first polymer component comprises a different polymer than the second polymer component, the bi-component continuous filament comprises a binding agent adhering the first polymer component to the second polymer component along a length of the filament, and the binding agent comprises polyethylene, ethylene-vinyl acetate, or polypropylene modified by maleic anhydride.

22. The bi-component continuous filament of claim 16, wherein the first polymer component comprises a polyamide, polyester, or polyolefin material.

23. The bi-component continuous filament of claim 16, wherein the first polymer component comprises a cationic polyamide or a cationic polyester.

24. The bi-component continuous filament of claim 16, wherein at least one of the first polymer component and the second polymer component comprises polyamide, wherein the polyamide comprises nylon 6; nylon 6,6; nylon 7; nylon 6, 10; nylon 6, 12; nylon 12; nylon 46; or nylon 1212.

25. The bi-component continuous filament of claim 16, wherein at least one of the first polymer component and the second polymer component comprises polyester, wherein the polyester comprises polyethylene terephthalate (PET), polybutylene terephthalate (PBT), or polytrimethylene terephthalate (PTT).

26. The bi-component continuous filament of claim 16, wherein at least one of the first polymer component or the second polymer component is solution dyed.

27. The bi-component continuous filament of claim 16, wherein the bi-component continuous filament is hank dyed.

28. The bi-component continuous filament of claim 16, wherein the bi-component continuous filament is raw white.

29. The bi-component continuous filament of claim 16, wherein the bi-component continuous filament has a cross-sectional shape which is circular, elliptical, trilobal, polygonal, or star-shaped.

30. The bi-component continuous filament of claim 16, wherein the core is arranged concentrically or eccentrically relative to the sheath.

31. The bi-component continuous filament of claim 16, wherein the bi-component continuous filament has a square cross-section.

32. The bi-component continuous filament of claim 16, wherein a functional additive is included in at least one of the first polymer component or the second polymer component.

33. The bi-component continuous filament of claim 16, wherein the bi-component continuous filament exhibits a denier per filament (DPF) ratio measuring from approximately 2 DPF to approximately 50 DPF.

34. The bi-component continuous filament of claim 16, wherein the bi-component continuous filament is comprised in a yarn measuring from approximately 500 to 3500 denier.

* * * * *